US007124447B2

(12) United States Patent
Arganese

(10) Patent No.: US 7,124,447 B2
(45) Date of Patent: Oct. 24, 2006

(54) WATCH HEAD REMOVABLY ATTACHABLE TO GLOVE

(76) Inventor: Thomas J. Arganese, 8635 W. Sahara Ave. #562, Las Vegas, NV (US) 89117

( * ) Notice: Subject to any disclaimer, the term of this patent is extended or adjusted under 35 U.S.C. 154(b) by 0 days.

(21) Appl. No.: 10/879,889

(22) Filed: Jun. 29, 2004

(65) Prior Publication Data

US 2006/0010561 A1 Jan. 19, 2006

(51) Int. Cl.
*A41D 19/00* (2006.01)

(52) U.S. Cl. ..... 2/160

(58) Field of Classification Search ..... 2/16, 2/20, 158–163; 368/3, 82, 84, 203, 205; 473/205

See application file for complete search history.

(56) References Cited

U.S. PATENT DOCUMENTS 1,524,137 A * 1/1925 Kastl et al. ..... 2/160
4,387,838 A * 6/1983 Jackson ..... 224/170
4,652,141 A * 3/1987 Arai ..... 368/278
4,761,835 A * 8/1988 Chen ..... 2/160
4,766,611 A * 8/1988 Kim ..... 2/160
4,862,521 A * 9/1989 Mann ..... 2/160
5,610,877 A * 3/1997 Adams et al. ..... 368/10
5,623,731 A * 4/1997 Ehrgott et al. ..... 2/160
5,688,183 A * 11/1997 Sabatino et al. ..... 473/212
5,733,201 A * 3/1998 Caldwell et al. ..... 473/202
6,213,634 B1 * 4/2001 Harrington et al. ..... 368/283
6,401,254 B1 * 6/2002 Boller ..... 2/161.2
6,519,207 B1 * 2/2003 Lukacsko ..... 368/10
6,728,971 B1 * 5/2004 Benavidez ..... 2/161.4

* cited by examiner

*Primary Examiner*—Gary L. Welch
(74) *Attorney, Agent, or Firm*—Donald W. Meeker

(57) ABSTRACT

A holding frame with interior tabs is attached inside an outer surface of a glove in a normal wrist watch position. A watch head with an outer peripheral groove in an outer perimeter matching an inner edge of the frame is snapped into the holding frame with the frame tabs snapping into the watch groove.

5 Claims, 3 Drawing Sheets

WATCH HEAD REMOVABLY ATTACHABLE TO GLOVE

BACKGROUND OF THE INVENTION

1. Field of the Invention

The present invention relates to watch and glove combinations and in particular to a watch with an outer peripheral groove and a glove having a sewn-in or glued mating ring with spaced tabs adapted to snap fit into the watch groove so that the watch snaps into the back of a glove having the ring for an instantly attachable and removable watch glove.

2. Description of the Prior Art

Gloves normally cover up a wrist watch so that it is inconvenient to pull the glove off far enough to view the wrist watch. It is sometimes imperative to be able to view a watch during a sports activity to check timing. In sports involving gloves, a wrist watch is normally covered up making it difficult, time consuming, and distracting to move the glove to view the wrist watch. In outdoor activity in cold weather it is often uncomfortable as well as inconvenient to move a glove to view a watch.

Apparel is important to athletes as well as many individuals involved in situations involving the wearing of gloves. Cumbersome and elaborate and overly complex or unnecessary parts, particularly straps or buckles to attach a watch to an outside of a glove are undesirable.

Furthermore, wearing a wrist watch and a glove, such as a golf glove, together distracts your swing and your game due to discomfort and restrictions in the wrist movement. During a golf game which can usually take as long as 5 hours to play a full round of golf it is important to keep track of the time. Keeping a wristwatch in a golf cart or golf bag makes your watch vulnerable to being lost, stolen or broken and does not provide instant easy access during play.

The prior art does not provide a simple fast easy-to-use system for wearing a watch on a glove with a clean uncluttered mounting.

U.S. Pat. No. 4,766,611 to Kim is for a golf glove and watch combination which uses a conventional golf glove without modification. Strap of the watch feeds through retaining slots on watch cases and has Velcro hooks on its surface facing away from the watch case. The strap extends partly around flap of the glove, so that ends of the strap engage Velcro loops on the underside of the flap. The golf glove has a pad of Velcro hooks beneath the flap for mating engagement of the Velcro loops on the underside of the flap. When the flap is pressed against the pad so that the Velcro loops and hooks (90) engage with ends of the strap in place, the watch is held securely in place.

U.S. Pat. No. 4,761,835 to Chen shows at least one information indication article, like a battery-activated watch, a compass, a thermometer, etc. is detachably or undetachably disposed in an information indication piece on the wrist and back of a glove portion in a conventional form. One end of the information indication piece is secured with a tightening ring. This ring and a tightening strip provided with Velcro fastener arrangements secure the glove on the user's wrist and dispose the information indication piece in a preferred observation orientation.

U.S. Pat. No. 4,862,521 to Mann claims a watch supporting, protecting and insulating device, wherein, a glove has a pocket, which retains and protects a timepiece, permits viewing of the timepiece, and facilitates storage of other articles in the pocket.

U.S. Pat. No. 4,652,141 to Arai puts forth a time apparatus which enables autocycle riders, marathon athletes, jogging runners, skiers etc. to see or check time only by the pushing motion of the thumb of the hand which wears the apparatus, without the need of the other hand.

U.S. Pat. No. 1,524,137 to Kastl et al. indicates a watch exposing glove which provides a coverable opening in the back wrist portion of the glove to reveal a watch underneath. The watch may be a conventional watch or one with a snap on band described in the patent.

U.S. Pat. No. 6,213,634 to Harrington et al. provides a combination of a wristband and watch which includes a tubular wristband having an inner layer of material, an outer layer of material, and a watch placed therebetween is disclosed. The inner layer has a slit formed therein and the outer layer has an opening formed therein. The slit and opening are substantially aligned. The watch has a base and a face attached to the base. The opening includes button-hole stitching. The face includes a rim and a recess is formed between the base and the rim. Once the watch is in place, the stitching fits snugly within the recess, thereby securing the watch within the opening.

U.S. Pat. No. 6,401,254 to Boller describes a device that counts and displays golf strokes per hole and per game and includes a golf glove and a counter attached to the golf glove, either by hook and loop fasteners, snaps, a magnet, or a pouch. The counter includes a hole strokes digital counter and display for counting and displaying the golf strokes per hole, a total strokes digital counter and display for counting and displaying the golf strokes per game, a stroke advance button that advances the hole stroke counter and display and the total strokes digital counter and display, a clear button that clears the hole strokes digital counter and display, either an on/off button or a two second timer that allows the total strokes digital counter and display to be cleared when the clear button is depressed for two seconds, and a power source that is either a battery interface or a solar cell.

What is needed is a simple fast easy-to-use system for wearing a watch on a glove with a clean uncluttered mounting

SUMMARY OF THE INVENTION

An object of the present invention is to provide a watch with a snap-on rim having an outer peripheral groove and a glove having a sewn-in mating ring so that the watch with the rim snaps into the back of a glove having the sewn-in ring for an instantly attachable and removable watch glove for a simple fast easy-to-use system for wearing a watch on a glove with a clean uncluttered mounting.

Another object of the present invention is to provide a system for attaching a watch to a glove which is inexpensive to manufacture.

One more object of the present invention is to provide a system for attaching a watch to a glove which is easy to install on the glove and easy to snap the watch on and off the glove.

In brief, the present invention provides a system for securing a watch head into a plastic ring which would be fastened between two pieces of material in a glove by either glue or sewing. Groves in the watch head and tabs around the outer circle of the plastic ring allows the watch head to easily and securely snap in and out of the plastic ring fastened into the fabric.

This system of the present invention refers to a watch head fastened into a back of a wrist section of a glove. More specifically a glove used for sports activities, such as golf, racquetball, baseball, working out, bike riding and any other activity where when a user is wearing a common wrist watch it interferes with the activity.

The watch design is preferably fabricated of light weight sturdy plastic with an analog face, although a digital face or other materials would also work. The watch head has a groove going around the entire outer parameter of the watch head to allow the watch head to securely snap into a specially designed sturdy plastic ring which has tabs mating with the groove around the inner perimeter of the plastic ring and a small space on the top of the plastic ring for the crown of the watch head to line up with which is located at 12 o'clock position on the watch head. This crown on the watch head is used for setting the time on the watch head.

This removable watch head is structured to securely snap in and out of the plastic ring fastened between an inner fabric/liner and outer fabric of the glove to allow easy removability so the glove can be replaced or interchanged with other sports designed gloves and glove colors, or the watch battery can easily be replaced.

An advantage of the present invention is that it enables a watch to be positioned on the outside of a glove to eliminate the discomfort and interference of trying to wear a regular watch under a glove during an activity involving hand and wrist movement.

Another advantage of the present invention is that it provides a system for instantly attaching and removing a watch head to and from an outside of a glove.

A further advantage of the present invention is that it provides a simple fast easy-to-use system for wearing a watch on a glove with a clean uncluttered mounting.

Yet another advantage of the present invention is that it provides a system for attaching a watch to a glove which is inexpensive to manufacture.

One more advantage of the present invention is that it provides a system for attaching a watch to a glove which is easy to install on the glove.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
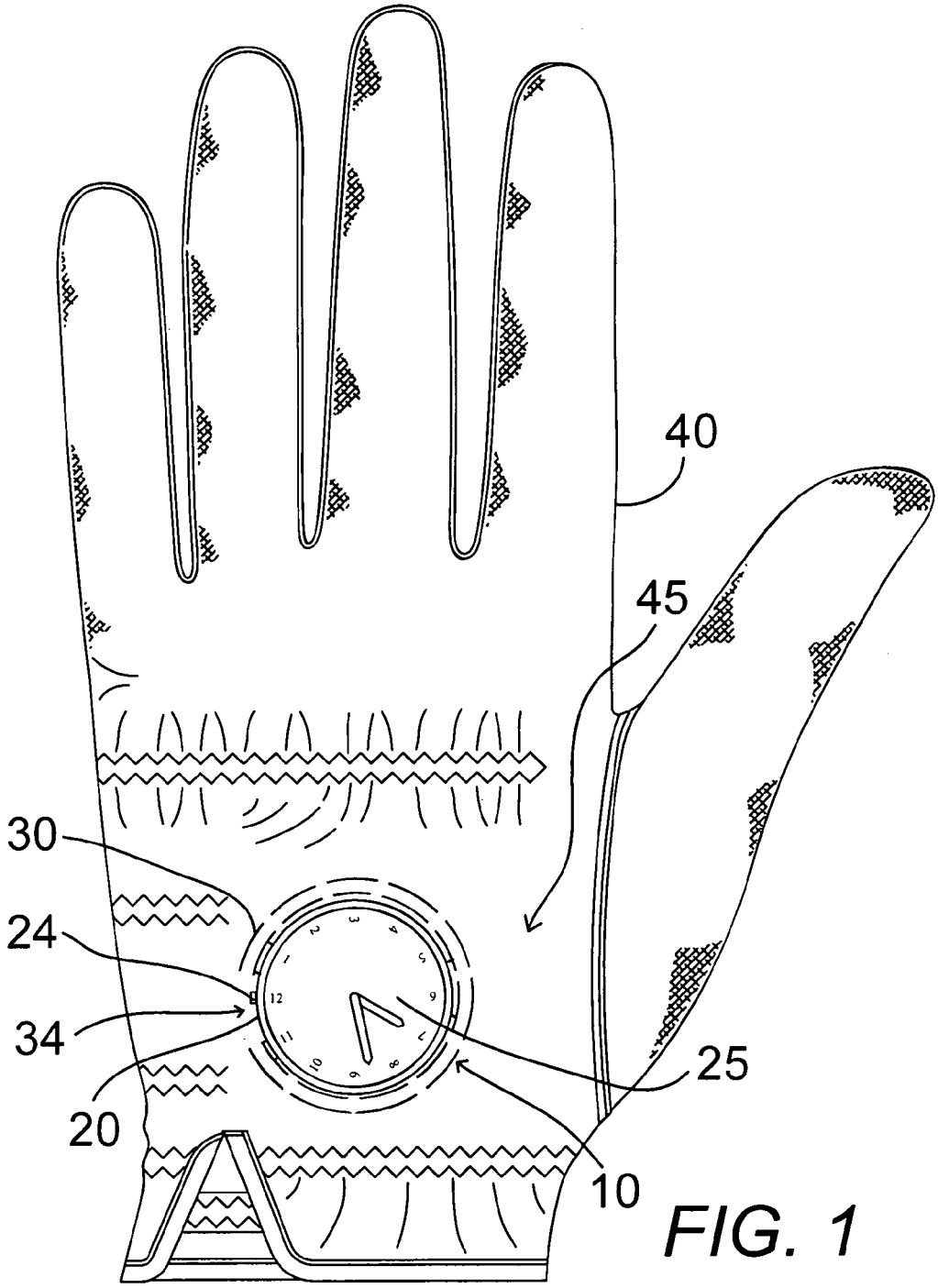
FIG. 1 is a top plan view of a back of a glove employing the system of the present invention for applying a watch head to the glove.

In FIGS. 1–6, a watch glove combination system 10 comprises a watch head 20 with a peripheral groove 23 and a mating holding frame 30 attachable inside an outer layer of fabric an a back of a glove 40 for a simple snap-on clean uncluttered mounting for a watch on a glove.

Figure 4:
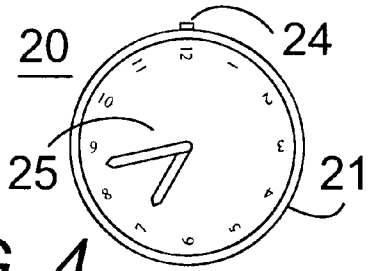
FIG. 4 is a top plan view of the face of a circular watch head employed in the system of FIG. 1.
Figure 5:
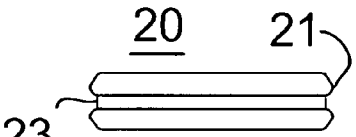
FIG. 5 is an edge-on elevational view of the circular watch head employed in the system of FIG. 1 showing the indented groove around the outer perimeter of the watch head.

In FIGS. 4 and 5, the watch head 20 comprises a face 25 for viewing a time of day and an outer peripheral edge 21 with a groove 23 indented therein around at least a portion of the edge.

Figure 6:
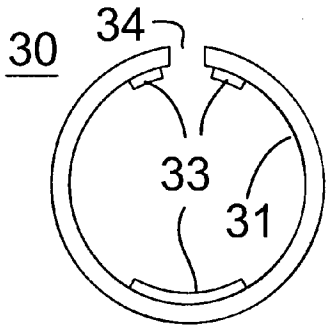
FIG. 6 is a top plan view of a circular holding frame of the present system of FIG. 1 having a break in the frame to accommodate the control knob of the watch head and spaced interior tabs to fit into the peripheral groove of the watch head.

In FIG. 6, the holding frame 30 comprising an open-center structure having an inner perimeter 31 matching the outer peripheral edge 21 of the watch head and spaced tabs 33 protruding inwardly from the inner perimeter. The spaced tabs are adapted to snap fit into the watch groove 23.

Figure 2:
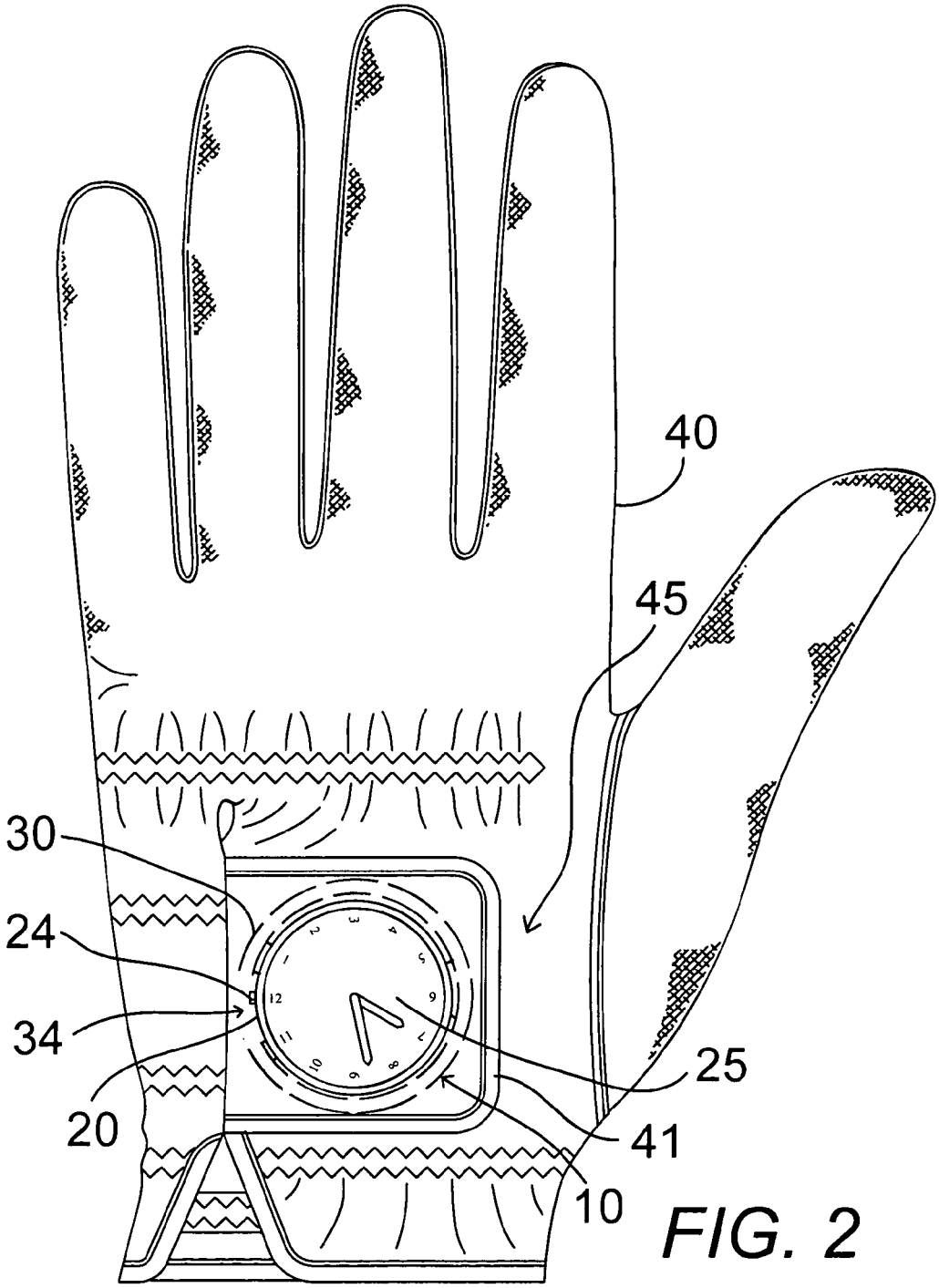
FIG. 2 is a top plan view of a back of a glove with an adjustment tab on the back employing the system of the present invention for applying a watch head to the adjusting tab.
Figure 3:
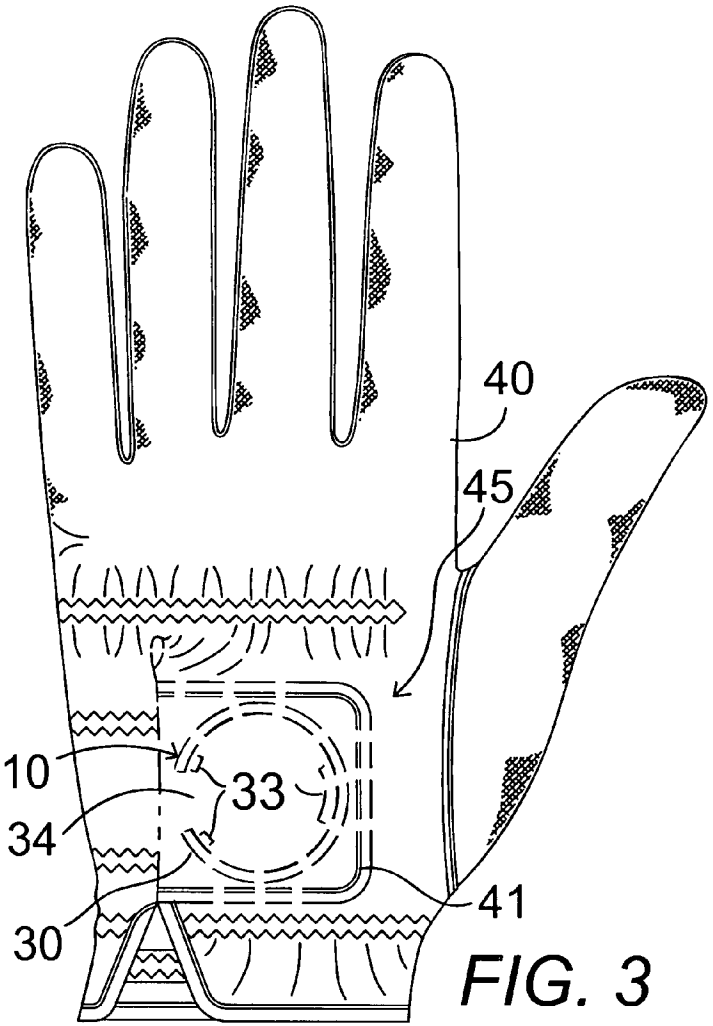
FIG. 3 is a top plan view of a back of a glove showing the holding frame attached under an outer surface of the glove or under a size adjustment tab on the back of the glove of the system of FIG. 1.

In FIGS. 1, 2, and 3, the holding frame 30 is adapted to be attached to an inner surface of an outer layer 45 of a glove fabric in a location of a wrist of a wearer so that the watch head 20 snaps into the holding frame 30 inside the back of a glove for an instantly attachable and removable watch head 20 on a glove 40 for viewing the time on an outside wrist portion of the glove 40.

In FIGS. 1, 2, and 4, the watch 20, in the case of an analog watch, may have a control knob 24 protruding from the peripheral edge and, in FIGS. 1, 2, 3, and 6, the holding frame 30 will have a mating break 34 in the holding frame adapted to position the watch head 20 in a position on the glove 40 for viewing the time on the face 25 of the watch head in a similar fashion to viewing the time on a wrist watch, as shown in FIGS. 1 and 2.

If there is a piece of material 41, such as a size adjusting flap or strap, attached to the back of the glove 40, is a natural wrist watch position, the holding frame 30 may be attached to the piece of material 41 attached to the glove 40 and the watch head 20 snapped into it, as shown in FIG. 2.

In FIG. 3, the holding frame 30 may be attached to the glove 40 by sewing or an adhesive or other means to secure the holding frame either inside the top surface 45 of the glove 40 or inside the outer material of a piece of material 41 attached to the glove 40 so that the watch head 20 may be snap-fit into the holding frame through the outer layer of the glove material with the tabs 33 inserted in the outer groove 23 of the watch and easily snapped out of the holding frame, as shown in FIGS. 1 and 2.

While the preferred embodiment shows a watch head 20 with a circular peripheral edge 21 and an annular holding frame 30 with a mating circular inner peripheral edge 31, any shape of watch head and holding frame with mating edges would work in the system.

In practice, the holding frame 30 is attached to the interior of the outer surface 45 of a glove 40 or inside an outer surface of a piece of material 41 attached to the glove, in the normal position of a wrist watch, by sewing or using an adhesive or other attaching means or the glove is sold with the holding frame pre-attached. The watch head 20 is easily snapped into and snapped out of the holding frame 30 on the glove 40 as desired.

It is understood that the preceding description is given merely by way of illustration and not in limitation of the invention and that various modifications may be made thereto without departing from the spirit of the invention as claimed.

What is claimed is:

1. A watch glove combination device with a simple snap-on clean uncluttered mounting, the device comprising in combination:

a glove comprising a finger portion, a palm portion covering a palm of a wearer, a back of the glove portion covering a back of the hand of the wearer, the back of the glove portion comprising at least one surface covering at least one outer layer of glove fabric having an outer surface exposed to view and an inner surface facing the back of the hand of the wearer;

a watch head comprising a face for viewing a time of day, a circular outer peripheral edge with an annular groove indented therein around at least a portion of the edge, and a control knob protruding from the outer peripheral edge;

a holding frame comprising a substantially annular structure having an open center and having an inner perimeter matching the outer peripheral edge of the watch head, spaced tabs protruding inwardly from the inner perimeter to snap fit into the watch groove, and a break in the annular structure to admit the control knob within the break and to enable the holding frame to expand to admit the watch head therein and to enable the holding frame to expand to release the watch head therefrom, the holding frame attached to the inner surface of the at least one outer layer of the glove fabric on the back of the glove portion so that the watch removably snaps onto the outside surface of the at least one outer layer of glove fabric on the back of the glove portion with the watch head removably snap-fit into the holding frame thereby forcing a compressed circular portion of the at least one outer layer of the glove fabric into an open center of the holding frame with an annular portion of the at least one outer layer of the glove fabric sandwiched between the watch head and the holding frame, with the tabs inserted in the annular groove of the watch by compressing a portion of the at least one outer layer of the glove fabric adjacent to each of the tabs into the groove for an instantly attachable and removable watch glove combination for viewing the time on the back of the glove portion.

2. The watch glove combination device of claim 1 wherein the glove further comprises a piece of material attached to the back of the glove portion, the piece of material comprising an inner surface facing the hand of the wearer and an out visible surface and the holding frame is attached to the inner surface of the piece of material attached to the glove.

3. The watch glove combination device of claim 2 wherein the piece of material comprises a glove strap.

4. The watch glove combination device of claim 1 comprising a sewing means for attaching the holding frame to the glove.

5. The watch glove combination device of claim 1 comprising an adhesive means for attaching the holding frame to the glove.

* * * * *